United States Patent [19]

Daniels

[11] Patent Number: 4,562,107

[45] Date of Patent: Dec. 31, 1985

[54] TEXTILE FABRICS WITH OPAQUE PIGMENT PRINTING AND METHOD OF PRODUCING SAME

[75] Inventor: John Y. Daniels, Pineville, N.C.

[73] Assignee: Springs Industries, Inc., Fort Mill, S.C.

[21] Appl. No.: 626,677

[22] Filed: Jul. 2, 1984

Related U.S. Application Data

[63] Continuation-in-part of Ser. No. 429,794, Sep. 30, 1982, Pat. No. 4,457,980, which is a continuation-in-part of Ser. No. 294,782, Aug. 20, 1981, abandoned.

[51] Int. Cl.[4] ..... B32B 3/00

[52] U.S. Cl. ..... 428/196; 427/282; 427/288; 427/389.9; 428/206; 428/207; 428/240; 524/444; 524/446

[58] Field of Search ..... 427/282, 288, 389.9; 524/444, 446; 428/196, 206, 207, 240

[56] References Cited

U.S. PATENT DOCUMENTS

| | | | |
|---|---|---|---|
| 2,310,436 | 2/1943 | Johnson | 8/14 |
| 3,067,053 | 12/1962 | Tarantino | 524/446 |
| 3,297,614 | 1/1967 | Pueschner et al. | 524/446 |
| 3,441,427 | 4/1969 | Skofroneck | 427/288 |
| 3,443,979 | 5/1969 | Skofroneck | 427/288 |
| 3,714,104 | 1/1973 | Bergome | 524/446 |
| 3,948,597 | 4/1976 | Sakaoka | 8/14 |
| 4,031,280 | 6/1977 | Weller et al. | 428/196 |
| 4,280,888 | 7/1981 | Buch et al. | 428/207 |
| 4,283,452 | 8/1981 | Marco | 428/206 |
| 4,315,790 | 2/1982 | Raltie et al. | 420/207 |
| 4,351,871 | 9/1982 | Lewis et al. | 428/196 |
| 4,395,499 | 7/1983 | Rosenski et al. | 524/446 |

FOREIGN PATENT DOCUMENTS

| | | |
|---|---|---|
| 1107636 | 5/1961 | Fed. Rep. of Germany . |
| 1444060 | 12/1968 | Fed. Rep. of Germany . |
| 1593299 | 7/1970 | France . |
| 2402733 | 4/1979 | France . |
| 589782 | 6/1947 | United Kingdom . |
| 926283 | 5/1963 | United Kingdom . |
| 929451 | 6/1963 | United Kingdom . |
| 954587 | 4/1964 | United Kingdom . |
| 954588 | 4/1964 | United Kingdom . |
| 954589 | 4/1964 | United Kingdom . |
| 1418906 | 12/1975 | United Kingdom . |
| 1433609 | 4/1976 | United Kingdom . |
| 1514504 | 6/1978 | United Kingdom . |

*Primary Examiner*—James J. Bell

*Attorney, Agent, or Firm*—Bell, Seltzer, Park & Gibson

[57] ABSTRACT

A method of printing textile fabrics, especially precolored fabrics of relatively dark shades, wherein a printing paste containing pigments and a heat curable binder is applied to selected areas of the fabric and the printing paste is thereafter dried and cured, said method being characterized by obtaining washfast, opaque printed areas substantially unaffected by the color of the underlying yarns, and by achieving high chroma, even on relatively dark background shades, said method comprising applying to the fabric an aqueous printing paste having a total solids content of at least 25 percent and comprising an aqueous dispersion containing a curable polymer binder, an opacifier containing at least one opaque pigment with minimal tinctorial value and a refractive index of less than 1.8, and at least one additional pigment for imparting a desired tinctorial value to the printing paste, and wherein the printing paste is applied to the fabric in an amount sufficient to form in the dried and cured fabric a washfast, opaque film-like pigmented coating penetrating each yarn and individually encapsulating and coating exposed fibers present at the surface of the yarns and hiding the underlying color thereof.

18 Claims, No Drawings

TEXTILE FABRICS WITH OPAQUE PIGMENT PRINTING AND METHOD OF PRODUCING SAME

CROSS REFERENCE TO RELATED APPLICATIONS

This application is a continuation-in-part of commonly-owned copending application Ser. No. 429,794, filed Sept. 30, 1982, now U.S. Pat. No. 4,457,980, issued July 3, 1984; which in turn is a continuation-in-part of commonly-owned copending application Ser. No. 294,782, filed Aug. 20, 1981, now abandoned.

FIELD AND BACKGROUND OF THE INVENTION

This invention relates to textile pigment printing, and in particular to the production of a printed textile fabric wherein the printed areas are opaque and are thus substantially unaffected by the color of the underlying yarns.

Textile pigment printing, by definition, involves the printing of an insoluble coloring material (pigment) on selected areas of a textile fabric. The pigment, which has no affinity for the fibers of the fabric, is adhered to the fabric by a resin binder. The term "resin-bonded pigment" is often applied to this type of textile printing process and product.

In conventional textile pigment printing operations, the pigment colorants and resin binder are in an aqueous emulsion in the form of a thick printing paste, and this printing paste is applied to the fabric by patterned rollers or by screens. After the paste is printed onto the fabric, the fabric is subjected to heat to dry and cure the resin binder.

In conventional resin-bonded pigment prints of this type, the printed areas are relatively transparent. While the pigments serve to color the yarns, the underlying color of the yarn shows through. For this reason, conventional pigment printing is usually done on an uncolored or white fabric, or on pastel shades. When conventional pigment printing is done on predyed fabrics, it is generally restricted to the printing of darker colors over a lighter background color. Conventional pigment print pastes, when applied to deep shades, do not produce an acceptable appearance. Due to the highly transparent nature of the conventional pastes and incomplete encapsulation of the surface fibers of the yarns, the color of the fabric ground shade is apparent through the pigment paste, which results in a severe change in shade of the desired printing color. For example, on a white or pastel colored fabric, the printing of a bright red print paste will remain bright red on the fabric; however, when printed on a black fabric, it will not produce the desired bright red shade. Instead, the printed area will be almost indistinguishable from the black ground shade.

Prior attempts have been made to overcome the effect of darker ground shades and to produce an opaque print by applying the printing paste to the fabric in a layer sufficiently thick or dense to completely cover and hide the underlying yarns. However, the resulting product exhibits poor appearance and poor washfastness properties. French Pat. No. 2,402,733, published Apr. 6, 1979, for example, mentions the possibility of adding titanium dioxide pigments to conventional print pastes to achieve the necessary opacity to print light shades on darker ground shades. The patent goes on to teach, however, that this approach is not satisfactory in that the paste was not sufficiently bonded to the support and simply made a crust on its surface. Further, the printed fabric had an unpleasant hand and exhibited poor washfastness and poor fastness to dry cleaning. To overcome these problems, the patent describes the use of a butadine based copolymer in combination with titanium dioxide pigments for opacity, applied to superficial areas in the immediate vicinity of the face of the fabric. However, fabrics produced in accordance with the teachings of the French patent have been shown to exhibit poor washfastness and durability. The patent does not teach the importance of encapsulation and coating of the exposed surface portion of the yarns and the individual fibers present at the surface of the yarns.

Furthermore, a further and very significant limitation of this formulation is its inability to produce shades with high color saturation (chroma). Although titanium dioxide serves as an effective opacifying pigment for printing a white or pastel area, its usefulness as an opacifying agent is severely limited when deep shades with high chroma are desired for the printed area. When mixed with colored pigments of the desired hue, the bright white titanium dioxide pigment will lower the apparent chroma of the paste, resulting instead in a subdued pastel coloration rather than the desired bright color of the added pigment.

It is an object of the present invention to provide an improved opaque printing formulation which provides opaque printed areas with significantly increased chroma (color saturation).

A further object of this invention is to achieve this high degree of opacity and chroma while maintaining the durability and washfastness properties needed in textile fabric applications.

SUMMARY OF THE INVENTION

In accordance with the present invention, these and other objects are achieved through the use of an aqueous opaque printing paste formulation and method of application as described more fully hereinafter.

The present invention provides a method of printing textile fabrics, especially precolored fabrics of relatively dark shades, to obtain washfast, opaque printed areas substantially unaffected by the color of the underlying yarns, the method being characterized by achieving high chroma, even on relatively dark background shades. The method comprises applying to the fabric an aqueous printing paste having a total solids content of at least 25 percent and comprising an aqueous dispersion containing a curable polymer binding, an opacifier containing at least one opaque pigment with minimal tinctorial value and a refractive index of less than 1.8, and at least one additional pigment for imparting a desired tinctorial value to the printing paste. The printing paste is applied to the fabric in an amount sufficient to form in the dried and cured fabric a washfast, opaque film-like coating penetrating each yarn and individually encapsulating and coating exposed fibers present at the surface of the yarns and hiding the underlying color thereof.

Preferably the opaque pigment used in the opacifier includes an inorganic aluminate or silicate pigment, and especially suitable for this purpose are aluminum silicate and sodium silico aluminate. The opacifier may also contain a dispersion of one or more of the above opaque pigments with pigments of different particle size and shape, such as titanium dioxide pigment, for example.

The aqueous printing paste of this invention may also optionally include relatively smaller amounts of other materials, such as crosslinking agents, thickeners, emulsifiers, pH control agents, and the like. The opacifying pigment and the curable polymer binders are the major constituents, however, and are present in concentrations such as to provide a printing paste with a very high solids content, e.g. preferably greater than about 25 percent total solids, which is considerably higher than conventional aqueous printing pastes. The printing paste desirably contains at least about 20 percent by weight pigment (solids basis) and at least about 5% by weight polymer binder (solids basis).

The paste is preferably applied to the fabric at a viscosity significantly higher than that used in the application of conventional print pastes of lower solids content. For example, while conventional rotary screen printing pastes are typically applied at a viscosity of about 8,000 to 15,000 cp, the printing paste of the present invention is applied to the fabric at a viscosity of greater than 20,000 cp, and desirably greater than 25,000 cp.

DETAILED DESCRIPTION

To serve as an opacifier for purposes of this invention, the material must be highly opaque, have color properties which permit it to be used alone or mixed with other colorants, such as colored pigments, and it must be readily dispersible at relatively high concentrations in the aqueous binder system. Additionally, in order to achieve high clor saturation (chroma), even on relatively dark background shades, proper selection of the optical properties of the opacifier, especially the refractive index, is highly important.

In producing opaque printing areas on textile fabrics, it has been found to be extremely difficult to achieve very vivid bright colors, especially reds, on dark backgrounds such as navy blue or black. The high level of opacifying pigment required to cover the dark color of the underlying fabric tends to dilute the color intensity or saturation of the colored pigments employed. However, by using as an opacifier opaque pigments with minimal tinctorial value (i.e. chromatic color or hue) and a refractive index of less than 1.8, it has been found possible to achieve very high levels of color saturation.

Suitable opaque pigments for this purpose may be selected from silicates, aluminum compounds, calcium carbonate, and the like. A preferred class of opaque pigments meeting these criteria are inorganic aluminates and silicates, and it has been found especially suitable to use at least one opaque pigment selected from the group consisting of aluminum silicate and sodium silico aluminate.

The opacifier may also include, in addition to the above-noted pigments, one or more other opaque pigments including the following: titanium dioxide, zinc oxide, zinc sulfide, lithopone ($ZnS/BaSO_4$), basic carbonate white lead, basic sulfate white lead, lead oxide (lead dioxide), calcium sulfate, barium sulfate, silica, clay ($Al_2O_3.2SiO_2.2H_2O$), lead sulfate, magnesium silicate, mica, wollastonite ($CaSiO_3$), aluminum hydrate, magnesium oxide, magnesium carbonate, aluminum oxide, ferric oxide, sodium carbonate, strontium sulfide, calcium sulfide, barium carbonate, antimonius oxide, zirconium white, barium tungstate, bismuth oxychloride, tin white, lead silicate, chalk, bentonite, barium sulfate, gloss white, gypsum, zinc phosphate, lead phosphate, and calcium silicate.

It has been found to be particularly suitable to use as the opacifier, mixtures of at least one of the above noted low refractive index pigments with at least one additional opaque pigment of a different particle size and shape. The differently sized and shaped pigments form a mutual dispersion which provides enhanced opacity. Especially suited for this purpose is titanium dioxide, which has a significantly higher refractive index of about 2.7. By mixing together titanium dioxide pigment with an aluminate or silicate pigment such as aluminum silicate or sodium silico aluminate, the different pigment diameters and shapes tend to produce better dispersion of the opacifying pigments, preventing clustering of the pigments and also filling interstices between the pigments to achieve greater covering power. Titanium dioxide, when used alone as an opacifying pigment without the presence of one or more of the lower refractive index opaque pigments, tends to significantly lower the chroma of the resulting printing area when mixed with a colored pigment. When mixed with a bright red pigment, for example, the resulting mixture tends to appear pink rather than bright red.

A further benefit of using an opaque pigment with a refractive index of less than 1.8 is that the light scattering properties are closer to that of the binder matrix. Consequently, interference by the opaque pigment particles with the colored pigment particles is reduced, resulting in greater effect from the colored pigment particles.

Furthermore, by using mixtures of lower refractive index opaque pigments with titanium dioxide, there is less total light reflection by virtue of the refractive indexes, and more total light interaction with colored pigment particles by virture of the refractive indexes. Furthermore, the mixture of pigment particles of different sizes and shapes tends to reduce agglomeration of the colored pigment particles and consequent color shift due to the refractive properties of the agglomerated color particles. This effect, which is sometimes referred to as "bronzing", exhibits itself in textile prints by a shift of red colored pigments toward a more brownish appearance.

The printing paste formulation may also include one or more additional pigments of predetermined desired colors for imparting the desired color to the printed area. Any of the colored pigments conventionally used in textile printing may be suitably employed.

The amount of total pigment used in the printing paste formulation of this invention is considerably greater than the amount of pigment used in conventional aqueous-based printing pastes, and is typically considerably greater than the total solids content of the polymer binder. In a preferred formulation, the printing paste comprises at least 20 weight percent opacifying pigment (solids basis) and at least 5 weight percent polymer binder (solids basis).

The polymer binder for the opacifying pigment must be capable of application in an aqueous system, form a stable dispersion with the insoluble opacifying pigments and other additives in the binder system, have good film-forming properties when applied to the fabric, and must be capable of being dried and cured to a water insoluble state imparting good washfastness and abrasion resistance properties to the printed pattern. The polymer binder may be suitably applied as an aqueous solution or as an aqueous dispersion or latex. The drying and curing of the print paste may be accomplished by suitable means, such as by heating, and various mechanisms may be employed for curing the binder, i.e., converting the polymer binder from an aqueous solution or dispersion as it is applied to a water insoluble state in the final product. For example, the curing may involve the reacting or splitting off of water solubilizing groups, such as carboxyls, condensation or addition polymerization, radiation curing or crosslinking.

One example of a particularly suitable curable polymer binder system for the opacifying pigment is an aqueous film-forming crosslinkable latex. The latex composition suitable for use in the present invention is a stable dispersion of polymers and/or copolymers in water which will effectively maintain the pigment in uniform suspension, and when printed onto the fabric, will coat the yarns of the fabric with a thin film of the latex and pigment. Upon heating, the latex film dries and cures, with a crosslinking reaction taking place between the reactive side groups of the polymer chains. There is thus formed a tough, flexible, water-insoluble pigmented opaque film around the yarns in the areas of the fabric where the printing paste is applied and encapsulating, the exposed fibers present at the surface of the yarns. This is particularly important, because fibers which are not coated with the print pastes will show through and detact from the color purity of the print design. If the particular latex polymer used is not itself heat reactive, then suitable catalysts or curing agents are added to promote curing and crosslinking upon heating.

A preferred class of film-forming aqueous latex for use with this invention are acrylic latexes. These are aqueous, anionic, colloidal dispersions of acrylate polymers and copolymers. An example of suitable commercially available acrylic latexes is the Hycar series of acrylic latexes available from B. F. Goodrich Company. Other heat reactive film-forming aqueous latexes suitable for use in the present invention include styrene-butadiene latexes, polyvinyl chloride and polyvinylidene chloride latexes, polyvinyl pyrimidine latexes, and polyacrylonitrile latexes.

To provide enhanced abrasion resistance and washfastness, a heat reactive crosslinking agent capable of crosslinking with the latex may optionally be included in the binder system. The crosslinking agent serves to reinforce the cured latex structure and thereby provide enhanced wet abrasion resistance and washfastness properties to the printed area. The crosslinking agent is a compound or resin (polymer) having functional groups capable of reacting with reactive sites on the latex under curing conditions to thereby produce a crosslinked structure. Examples of reactive chemical compounds suitable as crosslinking agents include aldehydes and dialdehydes such as formaldehyde and glyoxal. Examples of reactive thermoplastic or thermosetting resins suitable as crosslinking agents include glyoxal resins, melamines, triazones, urons, carbamates, acrylamides, and silicone resins. One particularly suitable type of heat reactive crosslinking resin is a melamineformaldehyde condensation product, one example of which is AEROTEX RESIN MW, produced by American Cyanamid Company.

The polymer binder system may also suitably employ polymers which are not themselves crosslinking and to which additional crosslinking agents are not added. Suitable nonreactive polymeric resins of this type may for example, be based on polyvinyl chloride or polyvinylidene chloride, such as the Geon series of resins available from B. F. Goodrich. Other suitable nonreactive resins include polyester resins, polysiloxane resins, polyvinyl alcohol and polyvinyl acetate. Instead of forming crosslinks, these resins, upon curing, fuse together the individual polymer particles to form individual polymer particles to form entangled polymer chains with good adhesive properties. The polymeric material selected may be applied either as a suspension, an emulsion or in solution.

Silicone fluids and elastomers may be incorporated into the printing paste to aid in obtaining a smooth application of the pigment to the fabric. The use of silicone polymers has been found to provide designs free of rough edges and crack marks. Silicone resin polymers may also be employed as a substitute for or in addition to the thermoplastic or thermosetting resins.

Conventional thickeners may also be utilized to control the viscosity and rheology of the paste, depending upon the size and design of the print pattern and the running speed of the print screen.

The paste may also contain other conventional additives, such as emulsifiers, antifoam agents, and pH control agents. It is important that the printing paste have good wetting and film-forming properties so that when applied to the fabric, it will penetrate and coat the individual yarns of the fabric rather than remaining on the surface of the fabric. If these properties are not adequately presented by the polymer binder itself, suitable wetting agents or emulsifiers may be included.

The printing paste may be applied either to uncolored (e.g. white) fabrics or to precolored fabrics, the precolored fabrics being of a predetermined color throughout and produced by any suitable method such as by piece dyeing, yarn dyeing or by pigment padding, for example.

The printing paste is applied in sufficient quantities so as to fully cover the exposed surfaces of the yarns in the printed areas. The particular rate of application of the printing paste to the fabric will vary depending upon various factors, including fabric weight and construction, color of the fabric, and printing color.

The opaque printing paste of this invention is preferably applied to the fabric at a much higher viscosity than that employed with conventional rotary screen printing pastes in order to achieve acceptable opacity. While conventional printing pastes for rotary screen printing are typically applied at a viscosity of about 8,000–15,000 cp, the present invention employs viscosity levels of at least 20,000 cp, preferably greater than 25,000 cp and typically two to three times higher.

In continued work with the opaque aqueous printing formulations described in the aforementioned commonly-owned U.S. Pat. No. 4,457,980, it has been found that the fabric substrate has significant effects on the appearance of the opaque print. For lightweight open weave fabrics, the print paste can penetrate between the individual yarns to the back of the fabric. In doing so, the individual yarns are fully encapsulated by the print paste. On tighter woven heavier weight substrates, the print paste does not penetrate between the individual yarns as easily, leaving a larger amount of the print paste near the surface that was printed, encapsulating the exposed surface portions of the yarns to hide the underlying color thereof, while penetrating into the yarn bundle sufficiently to form a secure bond. Depending upon the fabric construction, the print paste may or may not penetrate completely to the back of the fabric.

Drying and curing of the printing paste may be carried out under conditions of temperature and time conventional for the particular manner of application. For rotary screen printing, for example, drying and curing may be carried out at temperatures of 250 to 400 degrees F. for from several seconds up to several minutes. Energy savings and improved fabric properties may be realized by curing at lower temperatures, with the selection of a suitable low temperature curing polymer binder. For curing at low temperature, it may be desirable to include a crosslinking catalyst. The particular catalyst chosen would depend upon its compatibility with the crosslinking resin, the polymer binder, and the other components in the paste. Many latex and resin emulsions are known to precipitate in solution in the presence of acid catalysts and catalysts containing polyvalent ions such as are found in metallic and organo metallic catalysts such as magnesium chloride. One class of catalyst which has been particularly useful for low temperature curing is an ammonium capped sulfonic acid catalyst such as Quickset P. This catalyst is mildly acidic and does not disrupt the mildly alkaline pH for the latex mix in the quantities used. On curing, the ammonia is released, leaving the sulfonic acid group, which causes the pH to become acidic and providing an acid catalyst for the system. The catalyst would then behave as a conventional methane sulfonic acid or p-toluene sulfonic acid catalyst.

When the fabric is cured and dried, the areas printed with the printed paste are characterized by having a thin flexible opaque coating covering the exposed surfaces of the yarn and thus hiding from view the underlying color of the yarn. The coating consists predominantly of the opacifying pigment bonded securely to the yarns by the cured water insoluble polymer binder.

The following examples are given for purposes of illustrating the invention and how to practice the same. These examples are not intended to be understood as limiting the scope of the invention. All parts, percentages and ratios are by weight, unless otherwise indicated.

EXAMPLE 1

The following white print paste formulation was prepared.

| | Percent of Total Composition |
|---|---|
| Titanium dioxide dispersion (Pioneer White BS Pigment) | 75.0 |
| Acrylic latex binder (Hycar 2679 Latex - B. F. Goodrich) | 15.4 |
| Propylene glycol | 3.1 |
| Varsol | 3.1 |
| Aluminum silicate dispersion (Blockout B) | 13.1 |
| Thermosetting resin (Resin MW) | 4.6 |
| Ammonia | .8 |
| Catalyst (Quickset P - CMC Chemical) | .9 |
| Thickener Concentrate T | 1.5 |

This printing paste had a total solids content of about 55 percent of which about 44 percent was pigment and about 8 percent was latex binder.

A rotary screen printing range was utilized for printing the above formulation onto a dark color piece dyed polyester/cotton woven print cloth. The fabrics were cured at 350 degrees F. for 90 seconds.

EXAMPLE 2

The following print paste was prepared:

| | Parts by Weight |
|---|---|
| Aluminum silicate | 5 |
| Sodium silico aluminate | 10 |
| Acrylic polymer binder (40% solids) | 18.5 |
| Colored pigment | 20 |

The above mix was thickened to print viscosity with conventional print paste thickener and was printed and cured in the manner described in Example 1.

The following examples illustrate various noncrosslinking polymer binder systems which may be employed to produce the opaque prints of this invention.

EXAMPLE 3

Nonreactive Polyvinylchloride Latex

| | Percent of Total Composition |
|---|---|
| Titanium dioxide dispersion (Pioneer White BS Pigment) | 60 |
| Propylene glycol | 3 |
| Aluminum silicate dispersion (Blockout B) | 15 |
| Ammonia | 1 |
| Polyvinyl chloride latex (Geon ® Latex 460-6) | 20 |
| Thickener Concentrate T | 1 |

This mix is printed and thermally cured in the manner described in Example 1.

EXAMPLE 4

| | Percent of Total Composition |
|---|---|
| Titanium dioxide dispersion (Pioneer White BS Pigment) | 60 |
| Propylene glycol | 3 |
| Aluminum silicate dispersion (Blockout B) | 15 |
| Polyvinyl Alcohol (15% aqueous solution) | 20 |
| Ammonia | 1 |
| Thickener Concentrate T | 1 |

This system incorporates a water soluble binding system using polyvinyl alcohol. This system may be printed and cured in the manner described in Example 1. A subsequent treatment through a mild solution of sodium hydroxide followed by steaming and washing will yield improved permanence due to decreased solubility of the polyvinyl alcohol.

EXAMPLE 5

| | Percent of Total Composition |
|---|---|
| Titanium dioxide dispersion (Pioneer White BS Pigment) | 60 |
| Propylene glycol | 3 |
| Aluminum silicate dispersion (Blockout B) | 10 |
| Polyester size (Eastman Size WD) | 25 |
| Ammonia | 1 |

-continued

| | Percent of Total Composition |
|---|---|
| Thickener Concentrate T | 1 |

This noncrosslinking binding system incorporates water dispersible polyester size, Eastman WD. Improved durability is achieved by processing the printed and cured fabric through a mild caustic solution followed by steaming to insolubilize the sizing compound.

EXAMPLES 6–12

The following formulations were printed to determine what limits exist for the chemicals in relationship to print opacity and fastness properties. The fabric style used was Harmonaire Style 429 dyed black but unfinished. The mixes were adjusted to viscosities of approximately 40000 cps using Concentrate T. The samples were printed on the laboratory print machine using a striped screen pattern then cured in the Ahiba oven at 350 degrees F. for 90 seconds. The mixes were first printed white as made up. Next, 50 grams of the white base was taken to which 20 grams of Pigment Red 2B was added and the study repeated.

EXAMPLE 6

Grams/Mix

| | Mix 1 | Mix 2 | Mix 3 | Mix 4 | Mix 5 | Mix 6 |
|---|---|---|---|---|---|---|
| Titanium dioxide dispersion | 57 | 57 | 57 | 57 | 57 | 57 |
| Aluminum silicate/ calcium carbonate/ $TiO_2$ dispersion | 13 | 13 | 13 | 13 | 13 | 13 |
| Acrylic latex | 20 | 15 | 10 | 5 | 0 | 0 |
| Thermosetting resin | 10 | 8 | 6 | 4 | 2 | 10 |
| Ammonia | 1 | 1 | 1 | 1 | 1 | 1 |
| Catalyst | 1 | 1 | 1 | 1 | 1 | 1 |
| Thickener Concentrate T | * | * | * | * | * | * |
| WASHFASTNESS IIIA (White) | 4.0 | 2.5 | 2.0 | 1.5 | 1.0 | 1.0 |
| WASHFASTNESS IIIA (Red) | 5.0 | 4.0 | 2.3 | 1.5 | 1.0 | 1.0 |

*as needed to reach printing viscosity

EXAMPLE 7

Grams/Mix

| | Mix 1 | Mix 2 | Mix 3 | Mix 4 | Mix 5 |
|---|---|---|---|---|---|
| Titanium dioxide dispersion | 57 | 57 | 57 | 57 | 57 |
| Aluminum silicate/ calcium carbonate/ $TiO_2$ dispersion | 13 | 13 | 13 | 13 | 13 |
| Acrylic latex | 20 | 15 | 10 | 5 | 0 |
| Thermosetting resin | 0 | 0 | 0 | 0 | 0 |
| Ammonia | 1 | 1 | 1 | 1 | 1 |
| Catalyst | 0 | 0 | 0 | 0 | 0 |
| Thickener Concentrate T | * | * | * | * | * |
| WASHFASTNESS IIIA (White) | 5.0 | 4.0 | 2.5 | 1.5 | 1.0 |
| WASHFASTNESS IIIA (Red) | 4.0 | 2.5 | 1.5 | 1.5 | 1.0 |

*as needed to reach printing viscosity

EXAMPLE 8

Grams/Mix

| | Mix 1 | Mix 2 | Mix 3 | Mix 4 | Mix 5 |
|---|---|---|---|---|---|
| Titanium dioxide dispersion | 57 | 57 | 57 | 57 | 57 |
| Aluminum silicate/ calcium carbonate/ $TiO_2$ dispersion | 13 | 13 | 13 | 13 | 13 |
| Acrylic latex | 15 | 15 | 15 | 15 | 15 |
| Thermosetting resin | 8 | 6 | 4 | 2 | 0 |
| Ammonia | 1 | 1 | 1 | 1 | 1 |
| Catalyst | 1 | 1 | 1 | 1 | 1 |
| Thickener Concentrate T | * | * | * | * | * |
| WASHFASTNESS IIIA (White) | 5.0 | 4.0 | 4.0 | 4.0 | 3.0 |
| WASHFASTNESS IIIA (Red) | 4.0 | 4.0 | 4.0 | 4.0 | 2.5 |

*as needed to reach printing viscosity

The following mixes were prepared and printed as above to determine the effects on opacity and washfastness as the viscosity is varied. For each mix the viscosity was adjusted, the mix printed, the viscosity adjusted again, and so on. Target viscosities of 2000, 20000, 40000, and 80000 cp were attempted.

EXAMPLE 9

| | GRAMS/MIX | VISCOSITY (CP) | WASHFASTNESS IIIA |
|---|---|---|---|
| Titanium dioxide dispersion | 456 | 3000 | 5.0 |
| Aluminum silicate/ calcium carbonate/ $TiO_2$ dispersion | 104 | 23000 | 5.0 |
| Acrylic latex | 120 | 47000 | 5.0 |
| Thermosetting resin | 32 | 100000 | 4.0 |
| Ammonia | 8 | | |
| Catalyst | 1 | | |
| Thickener Concentrate T | * | | |

EXAMPLE 10

| | GRAMS/MIX | VISCOSITY (CP) | WASHFASTNESS IIIA |
|---|---|---|---|
| Titanium dioxide | 456 | 8000 | 4.0 |

-continued

| | GRAMS/MIX | VISCOSITY (CP) | WASHFASTNESS IIIA |
|---|---|---|---|
| dispersion | | | |
| Aluminum silicate/ calcium carbonate/ $TiO_2$ dispersion | 104 | 17000 | 4.0 |
| Acrylic latex | 120 | 47000 | 5.0 |
| Thermosetting resin | 0 | 100000 | 3.5 |
| Ammonia | 8 | | |
| Catalyst | 8 | | |
| Thickener Concentrate T | * | | |

EXAMPLE 11

| | GRAMS/MIX | VISCOSITY (CP) | WASHFASTNESS IIIA |
|---|---|---|---|
| Titanium dioxide dispersion | 456 | 1600 | 4.0 |
| Aluminum silicate/ calcium carbonate/ $TiO_2$ dispersion | 104 | 17000 | 3.5 |
| Acrylic latex | 80 | 40000 | 3.0 |
| Thermosetting resin | 32 | 70000 | 3.0 |
| Ammonia | 8 | | |
| Catalyst | 8 | | |
| Thickener Concentrate T | * | | |

EXAMPLE 12

| | GRAMS/MIX | VISCOSITY (CP) | WASHFASTNESS IIIA |
|---|---|---|---|
| Titanium dioxide dispersion | 456 | 1800 | 4.0 |
| Aluminum silicate/ calcium carbonate/ $TiO_2$ dispersion | 104 | 24000 | 3.5 |
| Acrylic latex | 40 | 37000 | 3.0 |
| Thermosetting resin | 32 | 90000 | 3.0 |
| Ammonia | 8 | | |
| Catalyst | 8 | | |
| Thickener Concentrate T | * | | |

That which is claimed is:

1. A method of printing textile fabrics, especially precolored fabrics of relatively dark shades, wherein a printing paste containing pigments and a heat curable binder is applied to selected areas of the fabric and the printing paste is thereafter dried and cured, said method being characterized by obtaining washfast, opaque printed areas substantially unaffected by the color of the underlying yarns, and by achieving high chroma, even on relatively dark background shades, said method comprising applying to the fabric an aqueous printing paste having a total solids content of at least 25 percent and comprising an aqueous dispersion containing a curable polymer binder, an opacifier containing at least one opaque pigment with minimal tinctorial value and a refractive index of less than 1.8, and at least one additional pigment for imparting a desired tinctorial value to the printing paste, and wherein the printing paste is applied to the fabric in an amount sufficient to form in the dried and cured fabric a washfast, opaque film-like pigmented coating penetrating each yarn and individually encapsulating and coating exposed fibers present at the surface of the yarns and hiding the underlying color thereof.

2. A method of printing textile fabrics, especially precolored fabrics of relatively dark shades, wherein a printing paste containing pigments and a heat curable binder is applied to selected areas of the fabric and the printing paste is thereafter dried and cured, said method being characterized by obtaining washfast, opaque printed areas substantially unaffected by the color of the underlying yarns, and by achieving high chroma, even on relatively dark background shades, said method comprising applying to the fabric an aqueous printing paste comprising at least 5 percent of an aqueous acrylic latex polymer, at least 20 percent of an opacifier containing at least one opaque pigment with minimal tinctorial value and a refractive index of less than 1.8, and at least one additional pigment for imparting a desired tinctorial value to the printing paste, all percentages by weight, solids basis, and wherein the printing paste is applied to the fabric in an amount sufficient to form in the dried and cured fabric a washfast, opaque film-like pigmented coating penetrating each yarn and individually encapsulating and coating exposed fibers present at the surface of the yarns and hiding the underlying color thereof while allowing the interengaged yarn structure of the fabric to remain visible.

3. A method according to claim 1 or 2 wherein said at least one opaque pigment with a refractive index of less than 1.8 is an inorganic aluminate or silicate pigment.

4. A method according to claim 3 wherein said inorganic aluminate or silicate pigment comprises at least one member selected from the group consisting of aluminum silicate and sodium silico aluminate.

5. A method according to claim 3 wherein said opacifier also includes titanium dioxide pigment dispersed with said opaque aluminate or silicate pigment.

6. A method according to claim 1 or 2 wherein the printing paste is applied to the fabric at a viscosity of at least 20,000 cp.

7. A method of printing textile fabrics, especially precolored fabrics of relatively dark shades, wherein a printing paste containing pigments and a heat curable binder is applied to selected areas of the fabric and the printing paste is thereafter dried and cured, said method being characterized by obtaining washfast, opaque printed areas substantially unaffected by the color of the underlying yarns, and by achieving high chroma, even on relatively dark background shades, said method comprising applying to the fabric an aqueous printing paste comprising at least 5 percent of an aqueous acrylic latex polymer, at least 20 percent of an opacifier containing titanium dioxide pigment dispersed with at least one opaque pigment with minimal tinctorial value and a refractive index of less than 1.8, and a curing catalyst, all percentages by weight, solids basis, and wherein the printing paste is applied to the fabric at a viscosity of at least 20,000 cp and in sufficient quantities so as to form in the dried and cured fabric a washfast, opaque film-like pigmented coating penetrating each yarn and individually encapsulating and coating exposed fibers present at the surface of the yarns and hiding the underlying color thereof while allowing the interengaged yarn structure of the fabric to remain visible.

8. A method of printing textile fabrics, especially precolored fabrics of relatively dark shades, wherein a printing paste containing pigments and a heat curable binder is applied to selected areas of the fabric and the printing paste is thereafter dried and cured, said method being characterized by obtaining washfast, opaque printed areas substantially unaffected by the color of the underlying yarns, and by achieving high chroma, even on relatively dark background shades, said method comprising applying to the fabric an aqueous printing paste comprising at least 5 percent of an aqueous acrylic latex polymer, at least 20 percent of an opacifier containing at least one pigment selected from the group consisting of aluminum silicate and sodium silico aluminate, at least one additional pigment for imparting a desired tinctorial value to the printing paste, a heat reactive crosslinkable thermosetting resin, and a curing catalyst, all percentages by weight, solids basis, and wherein the printing paste is applied to the fabric at a viscosity of at least 20,000 cp and in sufficient quantities so as to to form in the dried and cured fabric a washfast, opaque film-like pigmented coating penetrating each yarn and individually encapsulating and coating exposed fibers present at the surface of the yarns and hiding the underlying color thereof while allowing the interengaged yarn structure of the fabric to remain visible.

9. A printed textile fabric produced by the method according to any one of claims 1, 2, 7 or 8.

10. A printed textile fabric formed of precolored yarns of a predetermined relatively dark color, selected areas of said fabric having printed pattern areas of predetermined relatively lighter color contrasting with the darker color of the yarns, said printed pattern areas being opaque and thus substantially unaffected by the relatively darker color of the yarns and having high chroma, and said pattern areas comprising a washfast film-like opaque pigmented coating on the exposed surface portions of the individual yarns and individually encapsulating and coating exposed fibers present at the surface of the yarns and hiding the underlying color thereof while allowing the interengaged yarn structure of the fabric to remain visible, said opaque coating comprising an opacifier providing opacity in said coating and containing at least one opaque pigment with minimal tinctorial value and a refractive index of less than 1.8, at least one additional pigment of a predetermined tinctorial value for imparting the desired color to the printed area, and a latex polymer binder bonding said pigments to the yarns.

11. A fabric according to claim 10 wherein said at least one pigment with a refractive index of less than 1.8 is an inorganic aluminate or silicate pigment.

12. A fabric according to claim 11 wherein said inorganic aluminate or silicate pigment comprises at least one member selected from the group consisting of aluminum silicate and sodium silico aluminate.

13. A printed textile fabric formed of precolored yarns of a predetermined relatively dark color, selected areas of said fabric having printed pattern areas of predetermined relatively lighter color contrasting with the darker color of the yarns, said printed pattern areas being opaque and thus substantially unaffected by the relatively darker color of the yarns and having high chroma, and said pattern areas comprising a washfast film-like opaque pigmented coating on the exposed surface portions of the individual yarns and individually encapsulating and coating exposed fibers present at the surface of the yarns and hiding the underlying color thereof while allowing the interengaged yarn structure of the fabric to remain visible, said opaque coating comprising an opacifier providing opacity in said coating and containing at least one opaque pigment of predetermined particle size and shape and a refractive index of less than 1.8, and at least one additional opaque pigment of a different particle size and shape and forming a mutual dispersion of the differently sized and shaped particles for providing enhanced opacity, at least one additional pigment of a predetermined tinctorial value for imparting the desired color to the printed area, and a polymer binder bonding said pigments to the yarns.

14. A printed textile fabric formed of precolored yarns of a predetermined relatively dark color, selected areas of said fabric having printed pattern areas of predetermined relatively lighter color contrasting with the darker color of the yarns, said printed pattern areas being opaque and thus substantially unaffected by the relatively darker color of the yarns and having high chroma, and said pattern areas comprising a washfast film-like opaque pigmented coating on the exposed surface portions of the individual yarns and individually encapsulating and coating exposed fibers present at the surface of the yarns and hiding the underlying color thereof while allowing the interengaged yarn structure of the fabric to remain visible, said opaque coating comprising an opacifier providing opacity in said coating and containing titanium dioxide pigment dispersed with at least one opaque pigment with minimal tinctorial value and a refractive index of less than 1.8, at least one additional pigment of a predetermined tinctorial value for imparting the desired color to the printed pattern area, and a heat reactive polymer binder bonding said pigments to the yarns.

15. An aqueous printing paste composition for printing on textile fabrics, especially precolored fabrics of relatively dark shades, and characterized by providing washfast, opaque printed areas substantially unaffected by the color of the underlying yarns, and by achieving high chroma, even on relatively dark background shades, said aqueous printing paste composition having a total solids content of at least 25 percent and comprising at least 5 percent of an aqueous acrylic latex polymer, at least 20 percent of an opacifier containing at least one opaque pigment with minimal tinctorial value and a refractive index of less than 1.8, and at least one additional pigment for imparting a desired tinctorial value to the printing paste, all percentages by weight, solids basis.

16. A composition according to claim 15 wherein said at least one opaque pigment with a refractive index of less than 1.8 comprises at least one member selected from the group consisting of aluminum silicate and sodium silio aluminate.

17. A composition according to claim 16 wherein said opacifier also includes at least one additional opaque pigment of a different particle size and shape from said one opaque pigment with a refractive index of less than 1.8, and wherein said pigments form a mutual dispersion of the differently sized and shaped particles for providing enhanced opacity.

18. A composition according to claim 17 wherein said at least one additional pigment of a different particle size and shape comprises titanium dioxide.

* * * * *